US006152625A

United States Patent [19]

Oliverio

[11] Patent Number: 6,152,625

[45] Date of Patent: Nov. 28, 2000

[54] SENSOR HUB FOR A PRINT RIBBON SUPPLY ROLL AND METHOD

[75] Inventor: Michael S. Oliverio, Cornelius, N.C.

[73] Assignee: Fargo Electronics, Inc., Eden Prairie, Minn.

[21] Appl. No.: 09/361,618

[22] Filed: Jul. 27, 1999

[51] Int. Cl.[7] ..... B41J 33/32

[52] U.S. Cl. ..... 400/247; 400/249

[58] Field of Search ..... 400/247, 249, 400/207, 208, 196

[56] References Cited

U.S. PATENT DOCUMENTS

| | | | |
|---|---|---|---|
| 383,480 | 5/1888 | Osborne | 400/247 |
| 4,492,483 | 1/1985 | Guillaume | 400/208 |
| 4,797,018 | 1/1989 | Hofmann et al. . | |
| 4,810,116 | 3/1989 | Schulze et al. . | |
| 4,848,276 | 7/1989 | Brännström et al. . | |
| 4,872,027 | 10/1989 | Buskirk et al. . | |
| 4,907,902 | 3/1990 | Doi | 400/249 |
| 4,910,533 | 3/1990 | Sasaki et al. . | |
| 4,970,531 | 11/1990 | Shimizu et al. . | |
| 5,035,325 | 7/1991 | Kitsuki . | |
| 5,078,523 | 1/1992 | McGourty et al. . | |
| 5,079,565 | 1/1992 | Shimizu et al. . | |
| 5,087,137 | 2/1992 | Burnard et al. . | |
| 5,224,784 | 7/1993 | Haftmann et al. . | |
| 5,727,888 | 3/1998 | Sugimoto et al. | 400/247 |
| 5,755,519 | 5/1998 | Klinefelter . | |

*Primary Examiner*—Eugene Eickholt

*Attorney, Agent, or Firm*—Westman, Champlin & Kelly, P.A.

[57] ABSTRACT

A sensor hub for a print ribbon supply roll includes a sleeve shaped to attach to the roll core of the print ribbon supply roll, a pin-receiving plate secured to the sleeve and including a plurality of apertures, and a plurality of pins permanently secured in selected ones of the apertures. The pins are arranged in the apertures according to a print ribbon type to thereby identify the print ribbon type. The sleeve, pin-receiving plate and pins are preferably molded in a single step operation, thereby decreasing manufacturing time and reducing manufacturing costs. By molding the sleeve and pin-receiving plate around the pins, the pins can be permanently secured in the apertures of the pin-receiving plate, and the mold cavity can be constructed so as to eliminate susceptibility to human error.

42 Claims, 1 Drawing Sheet

SENSOR HUB FOR A PRINT RIBBON SUPPLY ROLL AND METHOD

BACKGROUND OF THE INVENTION

The present invention relates to a replaceable printer ink ribbon supply roll and, more particularly, to a replaceable printer ink ribbon supply roll including a sensor hub for identifying the print ribbon type.

Ink ribbon cartridges that are used in thermal printers are well known in the art. The cartridges usually include a casing or housing and at least one spool having a ribbon wound on the spool. The spool or supply roll rotates as the ribbon is fed through the printer during the printing operation.

Various kinds of ink ribbons with different characteristics are available. It is important to accurate and proper printer operation that the correct type of ribbon is inserted into the printer and that the printer itself is properly configured for a particular ribbon type. Exemplary ribbons include waxed ribbons, dye sublimation ribbons, or resin ribbons. Moreover, each of the ribbon types has variations that can be separately identified, including color.

Various ribbon identification devices have been proposed. For example, a device for identifying an ink ribbon cartridge used in a printer is shown in U.S. Pat. No. 5,385,416, which utilizes a photosensor to detect information marks recorded on a ring that has relative motion with respect to the ribbon spool or roll. The identifying information is sensed when the thermal printing head has moved to its operative position.

The present invention is, in particular, an improvement on another ribbon identification device described in U.S. Pat. No. 5,755,519, the disclosure of which is hereby incorporated by reference. In this patent, identifier indicia carried on a ribbon supply roll placed for indicating the type of ribbon that is on the supply roll is moved past a sensor during use to determine ribbon type or other coded information. In particular, one end of the supply roll is provided with a core insert or hub member that has a plurality of annularly spaced identifier indicia including sensor activating components. These components move past a stationary sensor to provide a signal from the sensor. Axially-extending openings or bores in the ribbon supply roll core receive pins as inserts that identify characteristics of the print ribbon.

Because the pins are removable, however, the pins cannot be reliably secured in the identifying hub member and may fall out during shipping, thereby rendering the ribbon useless. In addition, the manufacturing method is performed in multiple steps, requiring additional manufacturing time, thereby increasing manufacturing costs. One of these multiple steps is operator insertion of the pins into the hub, which process is susceptible to human error. Even a single misplaced pin would render the product unusable.

SUMMARY OF THE INVENTION

It is an object of the invention to provide an improved identifying sensor hub that overcomes the drawbacks associated with the prior art configurations. The improved sensor hub according to the invention includes permanently secured pins affixed in a pin-receiving plate that serve to identify the print ribbon type. The pins are thus prevented from falling out during shipping and/or use. Additionally, the sensor hub, including the permanently secured pins, is manufactured in a single manufacturing step, thereby reducing manufacturing time and costs and reducing susceptibility to human error in the manufacturing process.

According to one aspect of the present invention, there is provided a sensor hub for a print ribbon supply roll including a roll core. The sensor hub includes a sleeve shaped to attach to the roll core of the print ribbon supply roll. A pin-receiving plate is secured to the sleeve and includes a plurality of apertures. A plurality of pins are permanently secured in selected ones of the apertures, which pins are arranged in the apertures according to a print ribbon type to thereby identify the print ribbon type.

The pin-receiving plate may be formed integral with the sleeve, and the sleeve and the pin-receiving plate may be formed of a plastic material, such as high-impact polystyrene. The molded sensor hub may also include a second or user indicator of ribbon type, such as by color coding.

At least two of the pins are preferably secured in adjacent apertures, designating a home position. The pins are preferably formed of a magnetized ferromagnetic material. Moreover, each of the pins preferably includes a circumferential groove therein, receiving the pin-receiving plate. In this context, the pins may be molded with the pin-receiving plate.

The sleeve is preferably substantially cylindrical and includes a tapered end, wherein the sleeve is dimensioned to fit into the roll core of the print ribbon supply roll. The sleeve, the pin-receiving plate and the pins are preferably constructed of a one-piece integral unit that may be molded in a single step.

A deflector may be disposed on a sleeve side of the pin-receiving plate about a circumference of the pin-receiving plate. The deflector is an element used to facilitate ultrasonic welding of the hub to the print ribbon supply roll core.

According to another aspect of the invention, there is provided a print ribbon supply roll including a roll core, a print ribbon wrapped around the roll core, and the sensor hub according to the invention secured to the roll core.

In accordance with still another aspect of the invention, there is provided a method of manufacturing a sensor hub for a print ribbon supply roll. The print ribbon supply roll includes a roll core, and the sensor hub includes a sleeve shaped to attach to the roll core of the print ribbon supply roll, a pin-receiving plate having a plurality of apertures, and a plurality of pins permanently secured in selected ones of the apertures. The pins are arranged in the selected ones of the apertures according to a print ribbon type to thereby identify the print ribbon type. The method includes the step of molding the sleeve, the pin-receiving plate and the pins in a single step.

Prior to the molding step, the method may include the step of supporting the pins in a mold cavity. The supporting step is preferably practiced by preventing misplacement of the pins by blocking unused apertures in the mold cavity. The molding step may be practiced by molding the sleeve and the pin-receiving plate around the pins. In this context, the molding step is preferably practiced by injection molding a plastic material into the mold cavity.

In accordance with still another aspect of the invention, there is provided a method of manufacturing a print ribbon supply roll including a roll core, a print ribbon wrapped around the roll core, and the sensor hub according to the invention secured to the roll core. The method includes the steps of molding the sleeve, the pinreceiving plate and the pins in the sensor hub in a single step, and attaching the sensor hub to the roll core. The attaching step may be performed by ultrasonic welding. The molding step preferably includes molding the pin-receiving plate with a deflector disposed on a sleeve side of the pin-receiving plate about a circumference of the pin-receiving plate. In this context, the attaching step is performed by ultrasonic welding the deflector of the pin-receiving plate to the roll core.

BRIEF DESCRIPTION OF THE DRAWINGS

These and other aspects and advantages of the invention will be described in detail with reference to the accompanying drawings, in which.

DETAILED DESCRIPTION OF PREFERRED EMBODIMENTS

Figures 1, 2, 3, 4, 5:
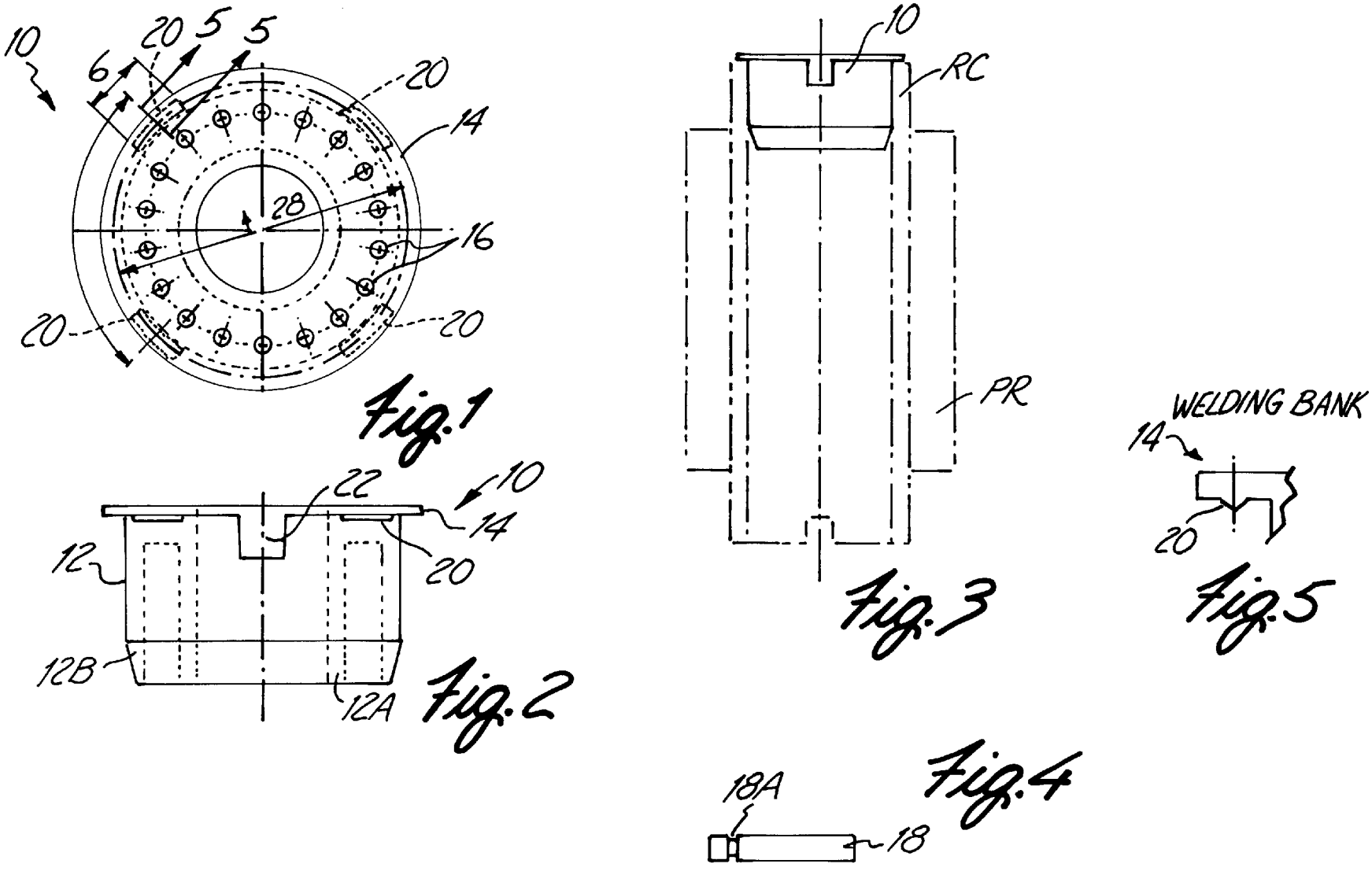
FIG. 1 is a top plan view of the sensor hub according to the invention.
FIG. 2 is a front elevation view of the sensor hub illustrated in FIG. 1.
FIG. 3 is a side view of the sensor hub installed in a print ribbon supply roll core.
FIG. 4 shows a pin that forms part of the sensor hub.
FIG. 5 is a cross sectional view along the line 5–5' in FIG. 1.

The sensor hub according to the present invention is suited for identifying a print ribbon type in a printer ribbon cassette. The printer and printer ribbon cassette do not form part of the present invention, and the structure and operation thereof will not be described in detail. Indeed, those of ordinary skill in the art will contemplate multiple applications within various printers and printer ribbon cassettes of the sensor hub according to the invention, and the invention is not meant to be limited to a particular printer type or printer ribbon cassette. An example of a suitable printer construction for the sensor hub according to the invention is described in U.S. Pat. No. 5,755,519, which was incorporated by reference above.

Referring to FIGS. 1–3, the sensor hub 10 according to the invention includes a substantially cylindrical shaped sleeve 12 extending from a pin-receiving plate 14, which is secured to the sleeve 12. An inner sleeve or extension 12A extends from the pin-receiving plate 14 for structural rigidity. An outside diameter of the sleeve 12 is dimensioned to be inserted into the roll core RC of a print ribbon supply roll including a print ribbon PR of a predetermined type. See, e.g., FIG. 3. As shown in FIG. 2, the sleeve 12 is tapered radially inwardly at an end 12B. The tapered sleeve facilitates the insertion of the sensor hub 10 into the ribbon core, resulting in a faster ribbon assembly prior to ultrasonic welding.

The pin-receiving plate 14 is provided with eighteen apertures 16 for receiving one or more of a plurality of pins 18 (see FIG. 4). As shown in FIG. 4, each of the pins is formed with a circumferential groove 18A for receiving the pin-receiving plate 14. The pins 18 are formed of a ferromagnetic material such as steel or the like and are magnetized. Any process of magnetization can be utilized provided that the strength of magnetization is sufficient to last for at least as long as the product shelf life. Typically, a printer ribbon cartridge shelf life is about one year. Pins of a ferromagnetic material that are exposed to a magnetization source can typically last for multiple years. Although the sensor hub can function with non-magnetized pins (according to sensor type), it is preferable to use magnetized pins because non-magnetized pins tend to develop rust if exposed to moisture in the package.

The pin-receiving plate 14 is also provided with one or more deflectors 20 as shown in FIGS. 1, 2 and 5. Four deflectors 20 are illustrated in FIG. 1, evenly spaced about a circumference of the pin-receiving plate 14. The deflectors 20 are formed on a sleeve 12 side of the pin-receiving plate 14 and serve as contact points for ultrasonic welding of the sensor hub 10 to the roll core of the print ribbon supply roll. The pin-receiving plate 14 also includes a pair of tab members 22 disposed at diametric opposite sides of the pin-receiving plate 14 as shown in FIG. 2. These tab members 22 serve to better seat the sensor hub 10 into the ribbon core RC. In addition, the tab members 22, when seated into the core, stabilize the two parts and allow for more accurate ultrasonic welding of the plastics. The prior art hub assembly additionally lacks this advantageous feature of the present invention.

In the manufacturing process, the sleeve 12 and the pin-receiving plate 14 are integrally molded with a plastic material such as high-impact polystyrene or HIPS. Of course, those of ordinary skill in the art will contemplate alternative suitable materials and manufacturing processes for the sensor hub according to the invention. For example, other moldable plastics as well as non-moldable materials may alternatively be utilized in the manufacturing process.

According to a preferred embodiment, molding is preferably performed in a one or two cavity mold. In this context, using a two cavity mold, two of the sensor hubs 10 according to the invention can be molded at a time, thereby further decreasing manufacturing time and reducing manufacturing costs. The appropriately placed pins are supported in the mold cavity prior to injection of the molding material.

In the manufacturing process, the pins 18 are arranged in selected ones of the apertures 16 according to a print ribbon type to thereby identify the print ribbon type. In order to ensure accurate placement of the pins, the mold cavity is prepared such that only the receiving apertures have areas for supporting the pins. The remaining apertures are blocked with suitable slugs or ejector pins. Ejector pins are used to eject the plastic part from the mold after cooling. With this arrangement, a human operator cannot inadvertently insert pins into incorrect positions. In the prior art apparatus described in the noted '519 patent, after molding the hub member, the plastic must be cooled, and then the pins are removably inserted in selected apertures. With this prior art construction, manufacturing time is increased, and the pin placement process is subject to human error.

During molding, the sleeve 12 and the pin-receiving plate 14 are molded around the pins 18 in a single step. The material forming the pin-receiving plate 14 is molded into the grooves 18A of the pins 18, thereby permanently securing the pins within the apertures 17. That is, with the sensor hub 10 according to the invention, the pins 18 cannot be removed without destroying the pin-receiving plate 14. With this construction, the plastic material molded around the entire pin serves as a locking device around the grooves, and the pins 18 are thus permanently secured in the respective apertures 16.

Another important improvement over the prior art hub member is the ability to effect color coding of the sensor hubs 10. As the pins 18 are particularly arranged according to a print ribbon type, a suitable sensor (discussed below) can discriminate the print ribbon type. By also color coding the sensor hubs according to print ribbon type, users can be provided with a visual indication/confirmation that the correct ribbon type is installed. Such color coding will also serve to facilitate consumer product recognition.

After the completed sensor hubs 10 are removed from the mold cavity and cooled, the sensor hubs 10 are secured to a roll core RC of a print ribbon supply roll. See FIG. 3. The sensor hub 10 is press fit into the roll core until an edge of the roll core contacts the deflectors 20. Subsequently, the sensor hub 10 is secured to the roll core by an ultrasonic welding process. The deflectors 20 thus serve as a welding bank for the welding process. In an alternative arrangement, the sensor hubs 10 may be secured to the roll core of the print ribbon supply roll solely by a friction fit. With this construction, many other suitable materials may be used for forming the components of the sensor hub 10.

In each assembly, preferably two pins 18 are secured in adjacent ones of the apertures 16 to designate a home position. The designated home position serves as an alert to a sensor such as a Hall Effect Sensor. In operation, as a pin 18 moves past the Hall Effect Sensor, magnetic flux lines at the Hall Effect Sensor will be disrupted or changed, causing a current output pulse from the Hall Effect Sensor. The integrally molded plastic material of the sleeve 12 and the pin-receiving plate 14 does not affect the magnetic flux lines as the ribbon supply roll rotates. A circuit board or like processing apparatus receives the signals from the Hall Effect Sensor and provides an appropriate output signal indicating the print ribbon type. Additional details of the Hall Effect Sensor and corresponding structure are described in the above-noted '519 patent.

With the structure according to the present invention, an improved sensor hub for a print ribbon supply roll in a printer ribbon cartridge can be inexpensively and reliably manufactured. The construction can be advantageously formed in a single molding step, and magnetized pins can be permanently and accurately secured to the sensor hub final construction without being susceptible to human error.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A sensor hub for a print ribbon supply roll including a roll core, the sensor hub comprising:

a sleeve shaped to attach to the roll core of the print ribbon supply roll;

a pin-receiving plate secured to said sleeve and including a plurality of apertures; and a plurality of pins permanently secured in selected ones of said apertures, said pins being arranged in the selected ones of said apertures according to a print ribbon type to thereby identify the print ribbon type.

2. A sensor hub according to claim 1, wherein said pin-receiving plate is formed integral with said sleeve.

3. A sensor hub according to claim 2, wherein said sleeve and said pin-receiving plate are formed of a plastic material.

4. A sensor hub according to claim 3, wherein said sleeve and said pin-receiving plate are formed of high-impact polystyrene.

5. A sensor hub according to claim 1, wherein at least two of said pins are secured in adjacent apertures, designating a home position.

6. A sensor hub according to claim 1, wherein said pins are formed of a ferromagnetic material.

7. A sensor hub according to claim 6, wherein said pins are magnetized.

8. A sensor hub according to claim 1, wherein each of said pins comprises a circumferential groove therein, said groove receiving said pin-receiving plate.

9. A sensor hub according to claim 8, wherein said pins are molded with said pin-receiving plate.

10. A sensor hub according to claim 1, wherein said pins are molded with said pin-receiving plate.

11. A sensor hub according to claim 1, wherein said sleeve is substantially cylindrical and comprises a tapered end, said sleeve being dimensioned to fit into the roll core of the print ribbon supply roll.

12. A sensor hub according to claim 11, wherein said sleeve, said pin-receiving plate, and said pins are constructed of a one-piece integral unit that is molded in a single step.

13. A sensor hub according to claim 1, further comprising a deflector disposed on a sleeve side of said pin-receiving plate.

14. A sensor hub according to claim 1, wherein said sleeve, said pin-receiving plate, and said pins are constructed of a one-piece integral unit that is molded in a single step.

15. A sensor hub according to claim 1, further comprising a user indicator of the print ribbon type.

16. A sensor hub according to claim 15, wherein the user indicator comprises color coding.

17. A print ribbon supply roll comprising:

a roll core;

a print ribbon wrapped around said roll core, said print ribbon being of a predetermined type; and a sensor hub secured to said roll core and including:

a sleeve shaped to attach to said roll core, a pin-receiving plate secured to said sleeve and including a plurality of apertures, and a plurality of pins permanently secured in selected ones of said apertures, said pins being arranged in the selected ones of said apertures according to said print ribbon type to thereby identify the print ribbon type.

18. A print ribbon supply roll according to claim 17, wherein said pin-receiving plate is formed integral with said sleeve.

19. A print ribbon supply roll according to claim 18, wherein said sleeve and said pin-receiving plate are formed of a plastic material.

20. A print ribbon supply roll according to claim 19, wherein said sleeve and said pin-receiving plate are formed of high-impact polystyrene.

21. A print ribbon supply roll according to claim 17, wherein said pins are formed of a ferromagnetic material.

22. A print ribbon supply roll according to claim 21, wherein said pins are magnetized.

23. A print ribbon supply roll according to claim 17, wherein each of said pins comprises a circumferential groove therein, said groove receiving said pin-receiving plate.

24. A print ribbon supply roll according to claim 23, wherein said pins are molded with said pin-receiving plate.

25. A print ribbon supply roll according to claim 17, wherein said pins are molded with said pin-receiving plate.

26. A print ribbon supply roll according to claim 17, wherein said sleeve is substantially cylindrical and comprises a tapered end, said sleeve being dimensioned to fit into the roll core of the print ribbon supply roll.

27. A print ribbon supply roll according to claim 26, wherein said sleeve, said pin-receiving plate, and said pins are constructed of a one-piece integral unit that is molded in a single step.

28. A print ribbon supply roll according to claim 17, further comprising a deflector disposed on a sleeve side of said pin-receiving plate.

29. A print ribbon supply roll according to claim 17, wherein said sleeve, said pin-receiving plate, and said pins are constructed of a one-piece integral unit that is molded in a single step.

30. A print ribbon supply roll according to claim 17, wherein the sensor hub further comprises a user indicator of the print ribbon type.

31. A print ribbon supply roll according to claim 30, wherein the user indicator comprises color coding.

32. A method of manufacturing a sensor hub for a print ribbon supply roll, the print ribbon supply roll including a roll core, and the sensor hub including a sleeve shaped to attach to the roll core of the print ribbon supply roll, a pin-receiving plate having a plurality of apertures, and a plurality of pins permanently secured in selected ones of the apertures, the pins being arranged in the selected ones of the apertures according to a print ribbon type to thereby identify the print ribbon type, the method comprising molding the sleeve, the pin-receiving plate and the pins in a single step.

33. A method according to claim 32, further comprising, prior to the molding step, the step of supporting the pins in a mold cavity.

34. A method according to claim 33, wherein the supporting step is practiced by preventing misplacement of the pins by blocking unused apertures in the mold cavity.

35. A method according to claim 32, wherein the molding step is practiced by molding the sleeve and the pin-receiving plate around the pins.

36. A method according to claim 35, wherein the molding step is practiced by injection molding a plastic material into a mold cavity.

37. A sensor hub for a print ribbon supply roll manufactured according to the method of claim 32.

38. A method of manufacturing a print ribbon supply roll including a roll core, a print ribbon wrapped around the roll core, and a sensor hub secured to the roll core, the sensor hub including a sleeve shaped to attach to the roll core, a pin-receiving plate having a plurality of apertures, and a plurality of pins permanently secured in selected ones of the apertures, the pins being arranged in the selected ones of the apertures according to a print ribbon type to thereby identify the print ribbon type, the method comprising:

molding the sleeve, the pin-receiving plate and the pins of the sensor hub in a single step; and attaching the sensor hub to the roll core.

39. A method according to claim 38, wherein the attaching step is performed by ultrasonic welding.

40. A method according to claim 38, wherein the molding step comprises molding the pin-receiving plate with a deflector disposed on a sleeve side of the pin-receiving plate.

41. A method according to claim 40, wherein the attaching step is performed by ultrasonic welding the deflector of the pin-receiving plate to the roll core.

42. A print ribbon supply roll manufactured according to the method of claim 38.

* * * * *